US007111328B2

(12) United States Patent
Bay

(10) Patent No.: US 7,111,328 B2
(45) Date of Patent: Sep. 26, 2006

(54) HYBRID VENTILATED GARMENT

(75) Inventor: Marc A. Bay, Farmington, MI (US)

(73) Assignee: Robison's Inc., Idaho Falls, ID (US)

( * ) Notice: Subject to any disclaimer, the term of this patent is extended or adjusted under 35 U.S.C. 154(b) by 87 days.

(21) Appl. No.: 10/366,625

(22) Filed: Feb. 13, 2003

(65) Prior Publication Data

US 2004/0158910 A1 Aug. 19, 2004

(51) Int. Cl.
*A41D 3/00* (2006.01)

(52) U.S. Cl. ..... 2/86; 2/93; 2/97; 2/DIG. 1

(58) Field of Classification Search ..... 2/455, 2/459, 461, 69, 85, 93, 97, 119, 126, 267, 2/268, 272, 904, 94, DIG. 1, 108, 102, 2.5, 2/114, 269
See application file for complete search history.

(56) References Cited

U.S. PATENT DOCUMENTS

| | | | | |
|---|---|---|---|---|
| 317,711 | A | 5/1885 | Brinkmann | |
| 367,921 | A | 8/1887 | Norton | |
| 375,504 | A | 12/1887 | Norton | |
| 385,306 | A | 6/1888 | Helwitz | |
| 1,015,231 | A | 1/1912 | Jacobs | |
| 1,250,004 | A | 12/1917 | Philip | |
| 1,360,390 | A | 11/1920 | Gilfillan | |
| 1,647,656 | A * | 11/1927 | Olsen | 2/115 |
| 1,648,282 | A | 11/1927 | Schneider | |
| 1,679,102 | A | 7/1928 | Thompson | |
| 1,693,464 | A | 11/1928 | Quantz | |
| 1,714,491 | A | 5/1929 | Burr | |
| 1,782,000 | A | 11/1930 | Collins | |
| 1,971,622 | A | 8/1934 | Quackenbush | |
| 1,973,421 | A | 9/1934 | Wallace | |
| 2,010,434 | A | 8/1935 | Langrock | |
| 2,073,711 | A | 3/1937 | Robinsohn | |
| 2,079,980 | A | 5/1937 | Anders | |
| 2,084,173 | A | 6/1937 | Wexler | |
| 2,114,514 | A | 4/1938 | York | |
| D115,983 | S | 9/1939 | Bailey | |
| 2,186,918 | A | 1/1940 | Wolf | |
| D119,122 | S | 2/1940 | Bauer | |
| 2,259,560 | A | 10/1941 | Glidden | |
| 2,291,861 | A * | 8/1942 | Astrove | 2/80 |
| 2,391,535 | A | 12/1945 | Zelano | |
| 2,458,004 | A | 1/1949 | Kerr | |
| 2,469,700 | A | 5/1949 | Petrucelli | |
| D160,800 | S | 11/1950 | Mandelbaum | |
| 2,585,840 | A | 2/1952 | Reynolds | |

(Continued)

FOREIGN PATENT DOCUMENTS

| | | |
|---|---|---|
| BE | 494309 | 3/1950 |

(Continued)

OTHER PUBLICATIONS

2000 Motorcycle—Joe Rocket® brochure, back page and p. 5 ("Bulldog" jacket), published in 1999.

(Continued)

*Primary Examiner*—Alissa L. Hoey

(57) ABSTRACT

A hybrid, ventilated garment is provided. Another aspect of the present invention employs a jacket having a body portion with sleeves and a torso, and a removable shell portion having sleeve and a torso segments. A further aspect of the present invention provides wind resistant shoulder and sleeve segments which are permanently attached together, and an air permeable and/or perforated lower torso segment attached to at least the shoulder segment.

47 Claims, 8 Drawing Sheets

U.S. PATENT DOCUMENTS

| | | | | | |
|---|---|---|---|---|---|
| 2,644,946 | A | | 7/1953 | Menz et al. | |
| 2,690,564 | A | * | 10/1954 | Kingston et al. | 2/105 |
| 2,700,769 | A | | 2/1955 | Polchinski | |
| 2,713,168 | A | | 7/1955 | Bagnato | |
| 2,715,226 | A | | 8/1955 | Weiner | |
| 2,722,694 | A | | 11/1955 | Bryant | |
| 2,989,754 | A | | 6/1961 | Bukspan | |
| 3,045,243 | A | | 7/1962 | Lash et al. | |
| 3,086,215 | A | | 4/1963 | Di Paola | |
| 3,153,793 | A | | 10/1964 | Lepore | |
| 3,213,465 | A | | 10/1965 | Ludwikowski | |
| 3,389,407 | A | | 6/1968 | Morrison | |
| 3,536,083 | A | | 10/1970 | Reynolds | |
| D220,822 | S | | 5/1971 | De Wan | |
| 3,638,241 | A | | 2/1972 | Holmes | |
| 3,691,564 | A | * | 9/1972 | La Marre et al. | 2/458 |
| 3,706,102 | A | | 12/1972 | Grenier | |
| 3,761,962 | A | | 10/1973 | Myers | |
| 3,771,169 | A | | 11/1973 | Edmund | |
| 3,921,224 | A | | 11/1975 | Ingram, III | |
| 3,924,273 | A | | 12/1975 | Donovan | |
| 3,969,772 | A | | 7/1976 | Pravaz | |
| D248,896 | S | | 8/1978 | Hasday et al. | |
| 4,122,553 | A | | 10/1978 | Pitkanen | |
| 4,170,793 | A | | 10/1979 | O'Brein | |
| 4,185,327 | A | | 1/1980 | Markve | |
| 4,195,362 | A | * | 4/1980 | Rolando | 2/461 |
| 4,390,996 | A | | 7/1983 | Read | |
| 4,397,043 | A | * | 8/1983 | Croteau | 2/456 |
| 4,408,356 | A | | 10/1983 | Abrams | |
| 4,422,186 | A | * | 12/1983 | Loney | 2/114 |
| 4,513,451 | A | | 4/1985 | Brown | |
| 4,554,682 | A | | 11/1985 | Hillquist | |
| 4,563,777 | A | | 1/1986 | Park | |
| 4,569,089 | A | | 2/1986 | Nesse | |
| 4,608,715 | A | | 9/1986 | Miller et al. | |
| 4,665,563 | A | * | 5/1987 | Harvey | 2/87 |
| 4,722,099 | A | | 2/1988 | Kratz | |
| 4,783,858 | A | * | 11/1988 | Chevalier | 2/90 |
| D306,511 | S | | 3/1990 | Jones | |
| D308,435 | S | | 6/1990 | Kushitani | |
| 4,995,115 | A | * | 2/1991 | Ellis | 2/69 |
| 4,996,723 | A | * | 3/1991 | Huhn et al. | 2/105 |
| 5,097,535 | A | | 3/1992 | Dye et al. | |
| 5,105,477 | A | | 4/1992 | Golde | |
| 5,105,478 | A | | 4/1992 | Pye | |
| 5,115,516 | A | | 5/1992 | Golde | |
| 5,133,086 | A | * | 7/1992 | Truitt et al. | 2/114 |
| D332,342 | S | | 1/1993 | Dye et al. | |
| 5,201,075 | A | | 4/1993 | Svetich | |
| 5,398,343 | A | * | 3/1995 | Kuracina | 2/115 |
| 5,507,042 | A | | 4/1996 | van der Slessen | |
| 5,555,562 | A | | 9/1996 | Holt et al. | |
| 5,592,691 | A | | 1/1997 | Ronald | |
| 5,603,646 | A | | 2/1997 | Tobias | |
| 5,640,715 | A | * | 6/1997 | Adams | 2/46 |
| 5,687,423 | A | * | 11/1997 | Ross | 2/93 |
| 5,704,064 | A | | 1/1998 | van der Sleesen | |
| 5,718,000 | A | | 2/1998 | Ost et al. | |
| 5,752,277 | A | | 5/1998 | van der Sleesen | |
| 5,774,891 | A | | 7/1998 | Boyer | |
| 5,799,330 | A | * | 9/1998 | O'Donoghue-Kitt | 2/114 |
| 5,829,059 | A | * | 11/1998 | Covington, Jr. | 2/79 |
| 5,845,336 | A | | 12/1998 | Golde | |
| 5,850,634 | A | * | 12/1998 | Toombs | 2/93 |
| 5,884,332 | A | | 3/1999 | Snedeker | |
| 5,924,135 | A | | 7/1999 | Worth | |
| 5,940,879 | A | * | 8/1999 | Whitehouse | 2/2.17 |
| 5,978,960 | A | * | 11/1999 | Wrightman | 2/2.15 |
| 6,018,819 | A | | 2/2000 | King et al. | |
| 6,085,353 | A | | 7/2000 | van der Sleesen | |
| 6,119,270 | A | | 9/2000 | Chou | |
| 6,163,883 | A | | 12/2000 | Hong | |
| D437,673 | S | | 2/2001 | DesJardins et al. | |
| 6,260,196 | B1 | | 7/2001 | van der Sleesen | |
| 6,263,510 | B1 | | 7/2001 | Bay et al. | |
| 6,263,511 | B1 | | 7/2001 | Moretti | |
| 6,298,485 | B1 | | 10/2001 | Heller | |
| 6,339,843 | B1 | | 1/2002 | Grilliot et al. | |
| 6,339,845 | B1 | | 1/2002 | Burns et al. | |
| 6,360,371 | B1 | | 3/2002 | Davey | |
| 6,405,377 | B1 | | 6/2002 | Davis | |
| 6,421,834 | B1 | | 7/2002 | Kester | |
| 6,460,185 | B1 | | 10/2002 | Hardy | |
| 6,490,734 | B1 | | 12/2002 | Blauer et al. | |
| D479,902 | S | * | 9/2003 | Brown | D2/831 |
| 6,675,389 | B1 | * | 1/2004 | Kublick | 2/2.17 |
| 6,684,408 | B1 | * | 2/2004 | Rindle et al. | 2/108 |
| 6,792,621 | B1 | | 9/2004 | Braun | |
| 6,792,622 | B1 | * | 9/2004 | Graves | 2/114 |
| 6,802,082 | B1 | | 10/2004 | Watley | |
| D498,037 | S | * | 11/2004 | Bay | D2/830 |
| 6,851,128 | B1 | * | 2/2005 | Parrotte | 2/108 |
| 6,854,130 | B1 | | 2/2005 | van der Sleesen | |
| 6,868,557 | B1 | | 3/2005 | van der Slessen | |
| 6,968,573 | B1 | * | 11/2005 | Silver | 2/227 |
| 2003/0013368 | A1 | | 1/2003 | Braun | |
| 2003/0033656 | A1 | | 2/2003 | Jaeger | |
| 2003/0172435 | A1 | | 9/2003 | Rindle et al. | |
| 2004/0055069 | A1 | | 3/2004 | Fayle et al. | |
| 2005/0015843 | A1 | * | 1/2005 | Roux et al. | 2/69 |

FOREIGN PATENT DOCUMENTS

| | | |
|---|---|---|
| CA | 2 344 726 | 10/2002 |
| DE | 517523 | 1/1931 |
| EP | 0 000 095 | 12/1978 |
| EP | 0 034 518 | 1/1981 |
| EP | 0 071 226 | 2/1983 |
| EP | 0 161 564 | 11/1985 |
| EP | 0 412 450 | 2/1991 |
| EP | 0 643 929 | 3/1995 |
| EP | 0 819 389 | 1/1998 |
| EP | 0 870 745 | 10/1998 |
| EP | 0 913 170 | 6/1999 |
| EP | 0 974 277 | 1/2000 |
| EP | 1 329 167 A2 | 7/2003 |
| FR | 1.029.851 | 3/1953 |
| FR | 1.220.511 | 1/1960 |
| FR | 2.094.362 | 1/1972 |
| FR | 2 127 140 | 9/1972 |
| FR | 2 413 052 | 12/1977 |
| FR | 2 460 634 | 7/1979 |
| FR | 2 546 759 | 12/1984 |
| FR | 2 783 138 | 3/2000 |
| GB | 461247 | 2/1937 |
| GB | 0 104 770 A | 3/1983 |
| JP | 48-12006 | 2/1973 |
| JP | 49-9409 | 1/1974 |
| JP | 50-11703 | 2/1975 |
| JP | 53-155409 | 12/1978 |
| JP | 55-176314 | 12/1980 |
| JP | 56-15732 | 2/1981 |
| JP | 57-147212 | 9/1982 |
| JP | 58-105410 | 7/1983 |
| JP | 59-4722 | 1/1984 |
| JP | 61-94510 | 6/1986 |
| JP | 7-2417 | 1/1995 |
| JP | 8-284009 | 10/1996 |
| WO | WO 94/00036 | 1/1994 |
| WO | WO 96/39056 | 12/1996 |
| WO | WO 02/01977 | 1/2002 |
| WO | WO 02/060287 | 8/2002 |

WO WO 03/006234 1/2003

OTHER PUBLICATIONS

Five photographs of Joe Rocket® "Bulldog" jacket (offered for sale before 2003).
"Fieldsheer Air Speed Jacket", Advertisement from Parts & Accessories, Motorcycleville.com, Year 2001 Model, (published Feb. 8, 2003) 1 page.
"Fieldsheer" Advertisement from Fieldsheeronline.com, (published Feb. 8, 2003), 24 pages.
"Joe Rocket" Catalog, Spring 2002, (published 2002), Cover page and pp. 4-5, 13, 32 and 35.
"Steve Largent Autographed Football Jersey Mesh", Advertisement from Collectibles.goantiques.com, 1996-2003, (published Feb. 8, 2003), 1 page.
Drawing of Fieldsheer Jacket with removable torso vest (offered for sale or publicly used prior to Feb. 13, 2003), 1 page.
European Search Report for EP 03 29 1709, 2 pages.
2001 Kushitani Riding Equipment Collection, 2001,9 pages.
Cabela's Master Catalog, Fall 1998, p. 50-51.
Red Head, Fall 1999, Specialist Catalog, p. 17.
AGV Aeromesh Textile Jacket, www.agvsport.com (2004).
Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com (Feb. 8, 2003).
Japanese publication with English translation entitled "Proto War-RJ" citing Kiss Racing (believed to have been published in 2000).

* cited by examiner

HYBRID VENTILATED GARMENT

BACKGROUND OF THE INVENTION

The present invention relates generally to a garment and more particularly to a hybrid ventilated garment.

Garments, such as jackets and combined pant/jacket racing suits, are commonly used by people operating motor sport vehicles such as a motorcycle, all-terrain vehicle or snowmobile. Such jackets and suits commonly employ an outer shell covering the complete torso and arms of the person, and an inner insulative liner which can be removed for warm weather use. For example, reference should be made to U.S. Pat. No. 6,263,510 entitled "Ventilating Garment" which issued to Bay et al. on Jul. 24, 2001. This patent is incorporated by reference herein.

Another conventional motorcycle jacket employed a leather torso have perforations on the shoulder, chest, back and lower torso regions. It also had solid and non-perforated sleeves sewn to the torso. A non-perforated and wind resistant vest was optionally provided to externally cover the perforated torso of the jacket but could be removed to allow air entry through the torso holes. A first vertical zipper was provided for the front of the jacket torso and a second front vertical zipper was provided for the vest. This conventional jacket, however, suffered from the disadvantages of allowing undesired air flow through the sleeve-to-torso openings between the vest and jacket interface, ultraviolet light penetrating through the perforated shoulders of the torso when the vest was removed thereby leading to sunburn of the wearer, crash protection not being provided at the shoulders of the jacket when the vest was removed, and the two-piece appearance of the vest and jacket being unattractive.

SUMMARY OF THE INVENTION

In accordance with the present invention, a hybrid, ventilated garment is provided. Another aspect of the present invention employs a jacket having a body portion with sleeves and a torso, and a removable shell portion having sleeve and a torso segments. A further aspect of the present invention provides wind resistant shoulder and sleeve segments which are permanently attached together, and an air permeable and/or perforated lower torso segment attached to at least the shoulder segment. In still another aspect of the present invention, an air permeable and/or perforated sleeve section is attached to an ultraviolet light blocking upper sleeve section and a dense weave shell is removably attachable to cover the air permeable sleeve section. In a further aspect of the present invention, a flap operably covers a supplemental and diagonal zipper without covering a main front and generally vertical zipper.

The present invention garment is advantageous over traditional jackets in that the present invention always provides ultraviolet light blockage along the wearer's shoulders and upper arm portions. The present invention is further advantageous by providing crash protective pads and/or body armor, at least some of which are preformed, even if an outer torso shell is removed. Moreover, the present invention is advantageous by allowing significant torso and sleeve ventilation for use in hot weather yet easily allows attachment of a wind resistant, and/or thermally insulating and/or waterproof portion to cover the underlying air permeable and/or perforated material. The present invention is also aesthetically fashionable and provides easy to use attachment systems which effectively reduce air entry holes when the ventilating material is covered. Additional advantages and features of the present invention will become apparent from the following description and appended claims, taken in conjunction with the accompanying drawings.

DETAILED DESCRIPTION OF THE PREFERRED EMBODIMENT

Figure 1:
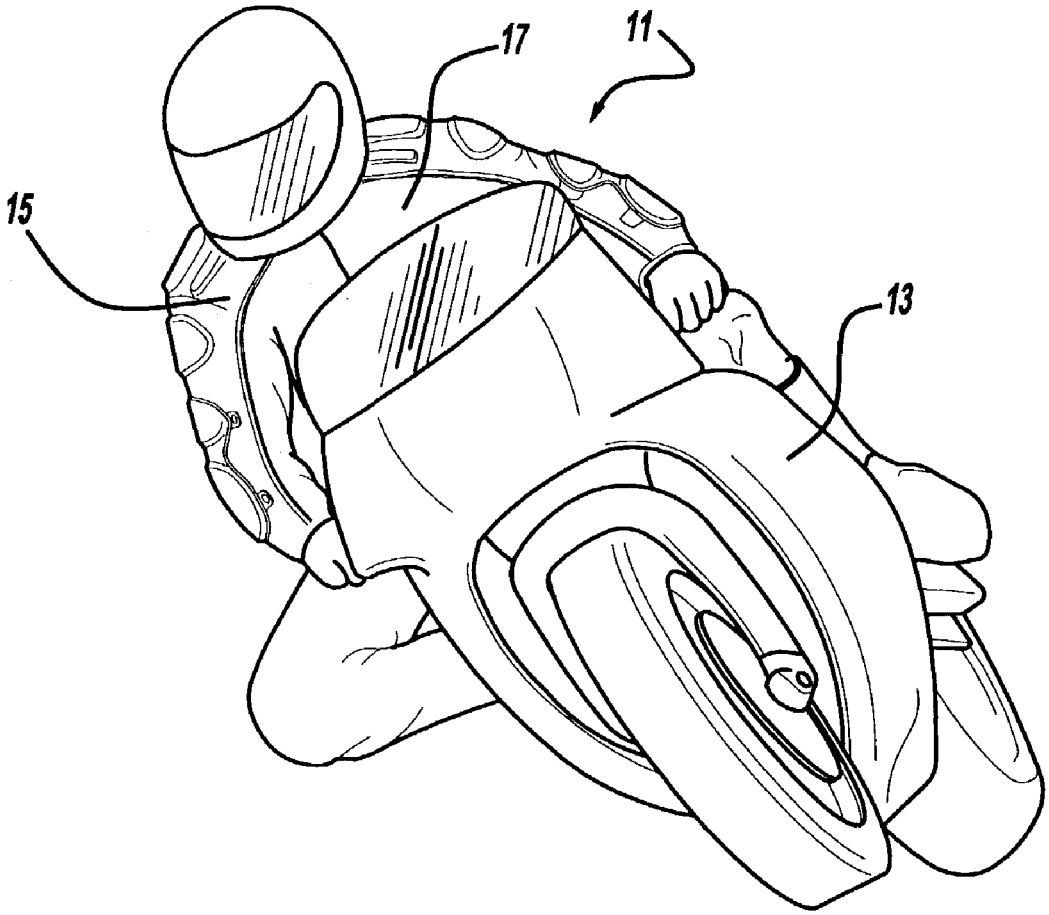
FIG. 1 is a perspective view showing the preferred embodiment of the hybrid ventilated garment of the present invention, used by a rider on a motorcycle.

Referring to FIGS. 1–3 and 8, the preferred embodiment of a hybrid ventilated garment, preferably a jacket 11 or a jacket portion of a combined jacket/pant racing suit, of the present invention is worn by a person riding a motorcycle 13 or other motorized vehicle such as an all-terrain vehicle or snowmobile. Hybrid jacket 11 includes two major portions, a body 15 and a shell 17. Body 15 has a mesh inner liner 24, an outer wind resistant material 25 and an outer mesh material 63.

Crash absorbing padding, also known as body armor, are positioned as follows. A pair of preformed, convex shoulder pads 19 are internally attached within pockets sewn to mesh inner liner 24. These pockets are closed at their top edges by hook and loop-type fasteners. Furthermore, preformed elbow pads 21 are inserted into internal pockets sewn to an inside of liner 24 and the elbow pockets are closed at their bottom edges by hook and loop-type fasteners. Three predominantly flat shoulder pads 23 are directly sewn to an inside surface of wind resistant material 25 located at each side of shoulder segment 27 of body 15. A mesh intermediate layer (not shown), locally sewn to the inside of wind resistant material 25 of each side of shoulder segment 27, assists in retaining shoulder pads 23 to material 25. A predominantly flat upper arm pad 29 is also sewn to the inside surface of the wind resistant material, with an additional and localized intermediate mesh, at each sleeve segment 31 of body 15 adjacent a sleeve-to-torso sewn seam 33. A generally flat upper back pad 35 is similarly sewn to an inside of wind resistant material 25 and secured by another localized, intermediate mesh material. Furthermore, a preformed, waffle-patterned, spine pad 37 is removably located in a pocket sewn within liner 24 having a horizontal hook and loop attachment and opening across a middle of the pocket. A generally flat, lower back pad 39 is sewn to the inside of a waistband segment 41, also made of wind resistant material 25. Finally, a pair of flat intermediate, back pads 79 and 81 are sewn to an inside surface of outer mesh fabric 63. The generally flat pads are more flexible than are the preformed ones and they are preferably made of a foam-like material. The preformed pads are preferably molded from multi-layer composite, resinated foam-like materials. Some of the body armor pieces disclosed herein, which aid in cushioning the impact the motorcycle user receives during motorcycle crashes, can be readily substituted or supplement by rigid polymeric panels having flat or three-dimensionally curved shapes.

A pair of sleeve diameter adjustments 41*a* are located on each sleeve 31 adjacent the elbow area. Each sleeve adjustment includes a fabric tab 43 upon which is mounted a female snap attachment 45. A pair of spaced apart, male snap attachments 47 protrude from the sleeve for selective attachment with female snap attachment 45. Moreover, a cuff adjustment 51 is disposed adjacent a distal open end 53 of each sleeve which corresponds to a wrist area of the user. Each cuff adjustment 51 includes a zipper assembly 55 with a flexible piece of triangularly-shaped fabric sewn between the zipper tracks and which can be expanded when the zipper 55 is unzipped or hidden from view when zipped. The positioning of cuff adjustments 51 and the body armor is highly advantageous by allowing same to be worn by the motorcycle rider regardless of whether hybrid jacket 11 is in its fully closed, wind blocking mode or in its fully ventilated mode with shell 17 removed from body 15 as will be discussed in greater detail hereinafter.

Referring now to FIGS. 6–9, a lower torso segment 61, herein defined as the entire front, back and side areas of the jacket body between shoulder segment 27 and waistband 41, is made from outer mesh fabric material 63 and perforated liner 24 which are air permeable for two-way ventilation. A front central and vertically elongated zipper attachment system 65 is disposed on the front of torso segment 61 and includes a pair of parallel zipper tracks with teeth and a zipper pull slide. Outer mesh material 63 laterally extends around the entire torso from zipper track to zipper track of central zipper system 65 and is interrupted by front piping welts 67 and zipped pocket openings 69 sewn thereto. Outer mesh material 63 is further located on the lower areas of each sleeve 31 extending from distal end 53 to armpit seam 33. Thus, outer mesh material 63 is permanently sewn to wind resistant material 25 along the entire front and rear sleeve segments 31 and shoulder segment 27 with a piping welt 71, supplemental frontal zipper attachment systems 73 and a continuous rear zipper attachment system 75*a* therebetween. Each zipper system includes a pair of toothed zipper tracks and a zipper pull slide. In other words, rear zipper system 75*a* extends from one sleeve distal end 53, horizontally across the back of the torso and to the opposite sleeve distal end 53. Inner liner 24 is sewn essentially within the entire body 15 of jacket 11 between internally folded cuffs at distal ends 53 of the sleeves, and between waistband 41 and an upper collar 75, except at wind resistant storm flaps 76 extending inwardly by between 60–100 millimeters from the zipper tracks associated with central zipper system 65. An optional pant zipper attachment 77 is horizontally sewn across an inside surface of inner liner 24 at a back of the torso segment between spine pad 37 and waistband 41.

Outer mesh material 63 is preferably a knitted, polypropylene fabric having perforated holes of approximately 3 millimeters high at dimension "a" by approximately 2 millimeters wide at dimension "b" (see FIG. 9); one such fabric can be obtained from Geo Change Fabric Co. stock number GCN-7151, SH-Mesh. Inner liner 24 is preferably a lighter weight, polyester knitted fabric having perforated holes of approximately the same size as for the outer mesh material but offset therefrom when sewn into the garment. The much denser wind resistant and ultraviolet light blocking material 25 located on body 15 and shell 17 are preferably a 600 denier polyester fabric having a polyurethane inside coating, but may alternately be Taslen or Cordura ® brand nylon fabric.

Waistband 41 includes a pair of elastic sections 81 with vertical stitches between each fold and an inner elastic strip which laterally contracts. A waist attachment system 83 is also provided at each forward side of waistband 41. Each waist attachment system 83 includes a fabric flap sewn adjacent elastic section 81 with a female snap attachment secured thereto. Three horizontally spaced male attachments protrude from a laterally outboard section of waistband 41 for selective fastening to the female snap attachment.

Collar 75 includes an outer layer made of wind resistant material 25 and an attached inner layer lined with a fleece-like material. A female snap attachment 85 is secured to a protruding front end of collar 75 while selectively matable and spaced apart male attachment fasteners 87 are secured to the opposite end of collar 75 to allow variable diameter neck closure.

Figure 2:
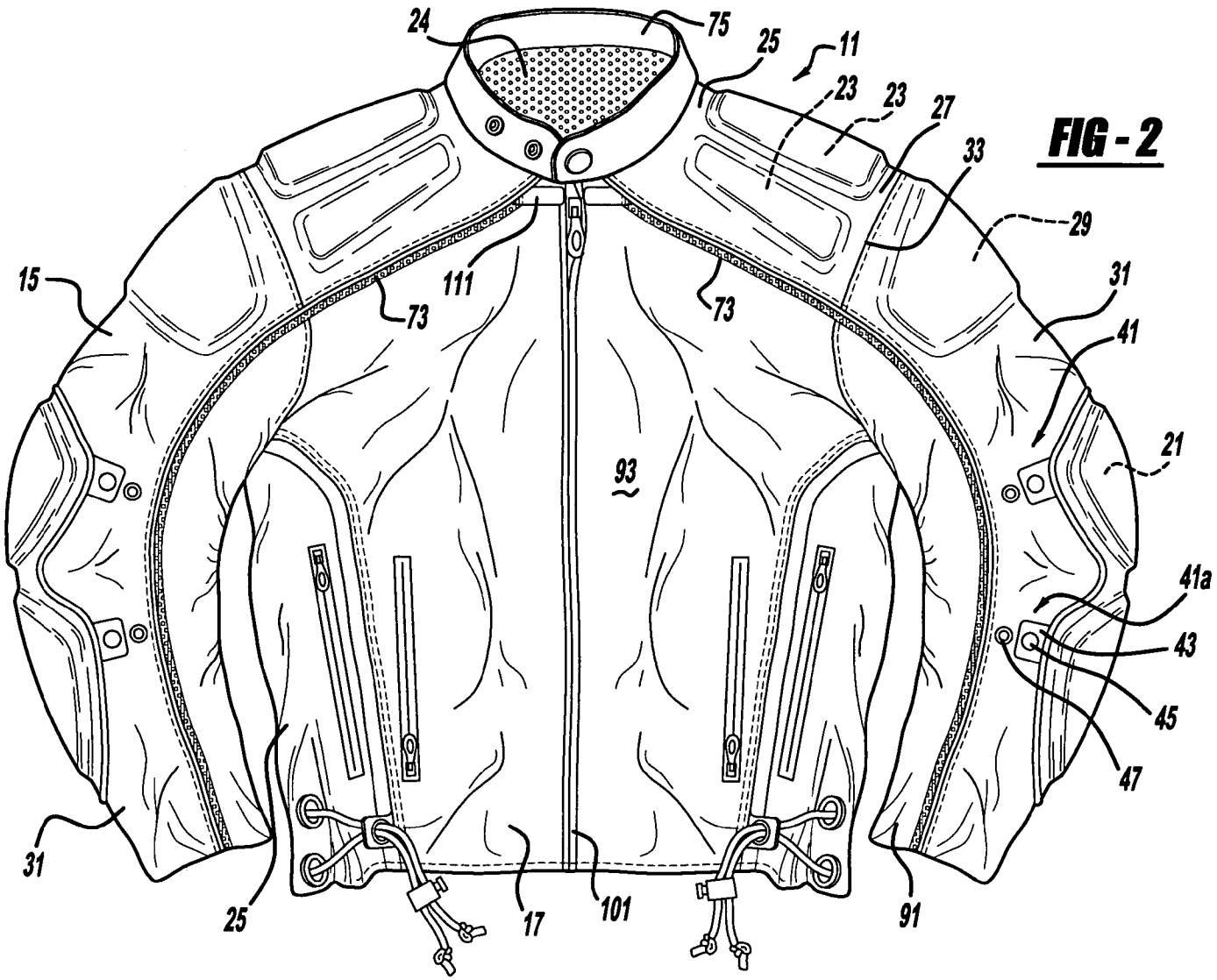
FIG. 2 is a front elevational view showing the preferred embodiment garment, with a shell attached to a body.
Figure 3:
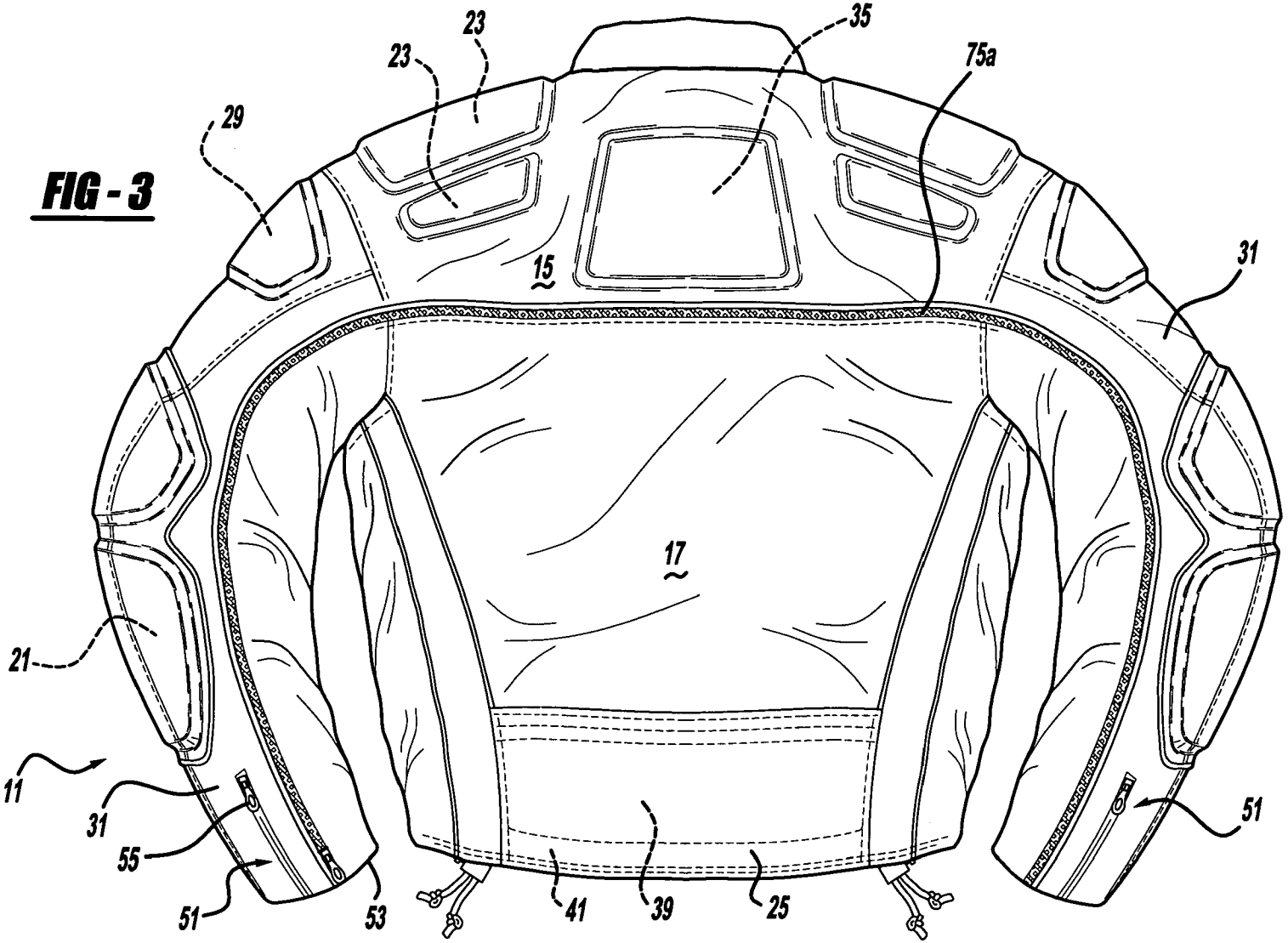
FIG. 3 is a rear elevational view showing the preferred embodiment garment, with the shell attached to the body.
Figure 8:
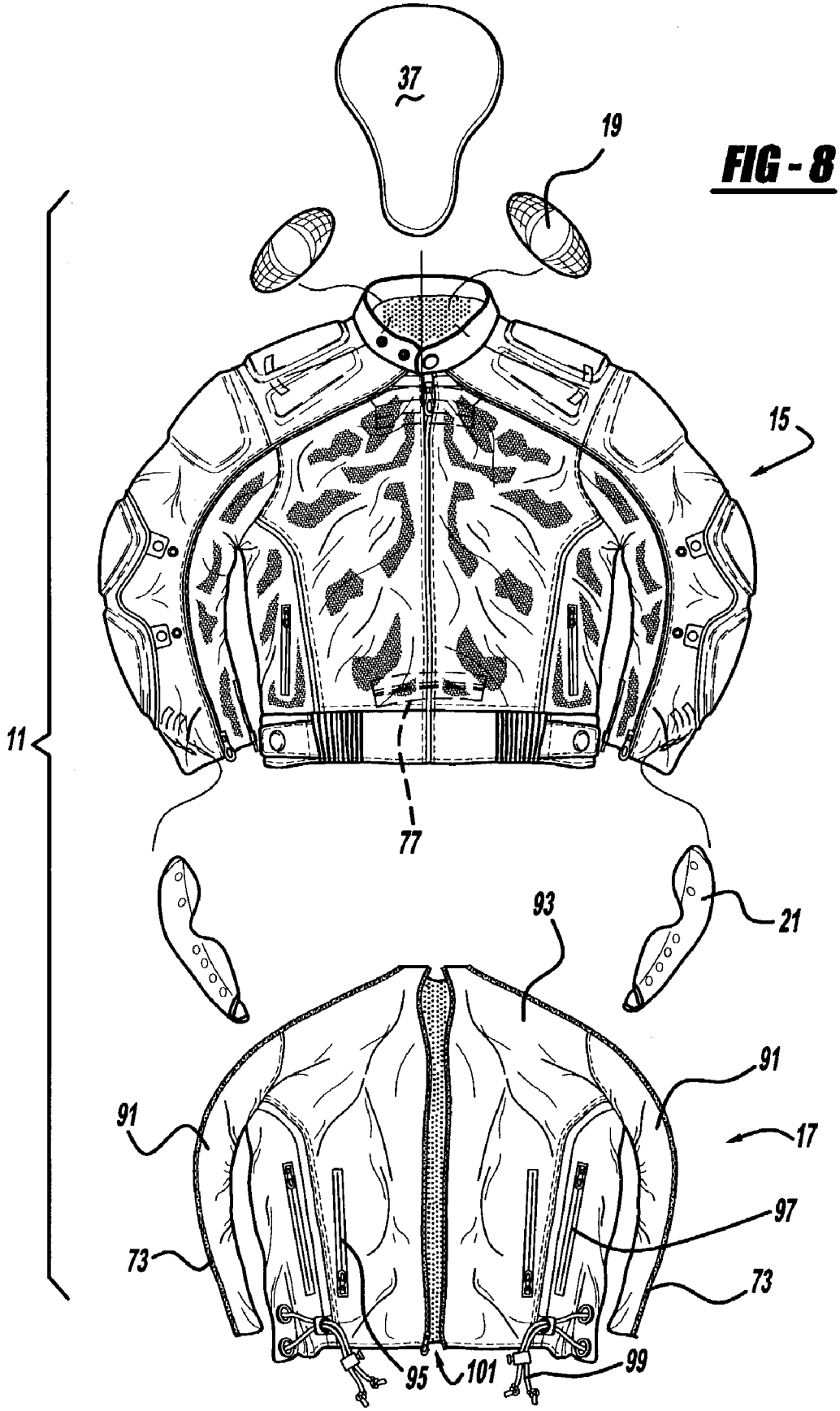
FIG. 8 is a partially exploded, front elevational view showing the preferred embodiment garment.
Figure 9:
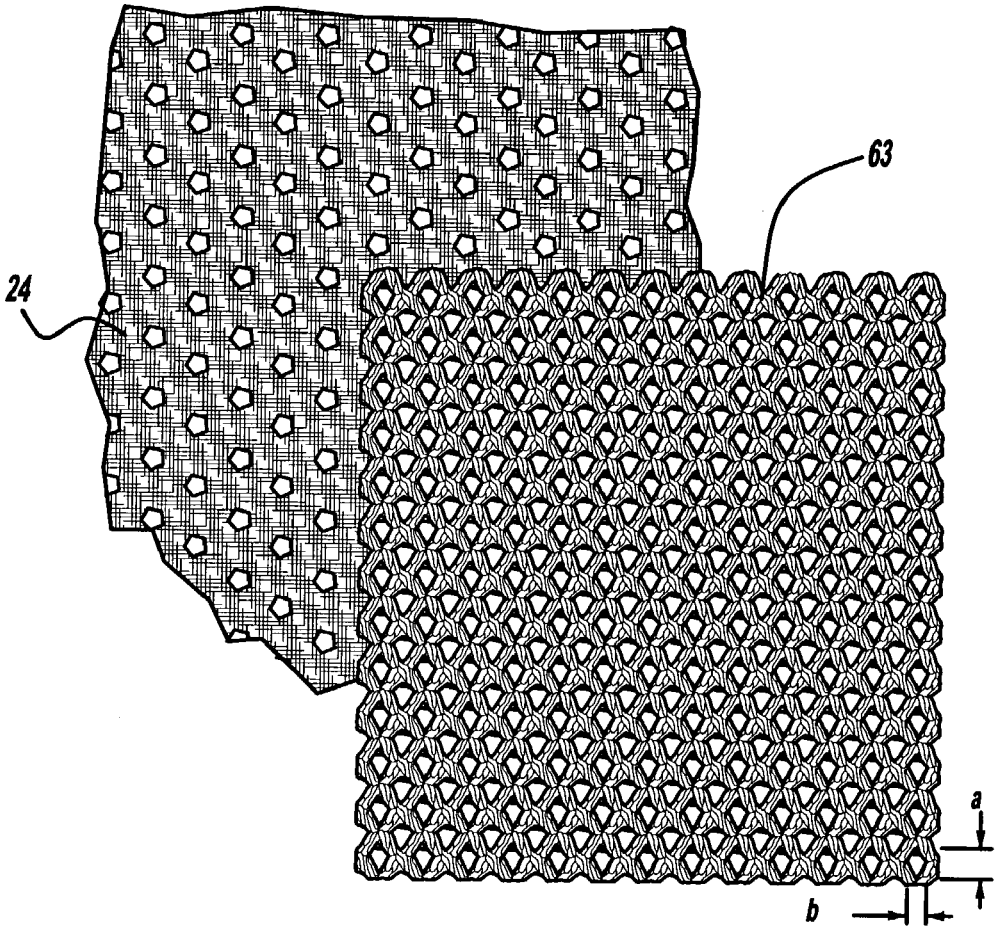
FIG. 9 is an enlarged and fragmentary, front elevational view, taken with circle 9 of FIG. 6, showing the air permeable mesh employed in the preferred embodiment jacket.

Shell 17 can best be observed in FIGS. 2, 3 and 8. Shell 17 includes left and right sleeve halves 91 which are permanently sewn to a lower torso segment 93. Shell 17 includes an outer fabric layer 121 made from the wind resistant material and an inner fabric layer 123 made of the perforated liner material like the body. One each zipper track of supplemental zipper attachment systems 73 and 75*a* are sewn to an upper edge of sleeve half segments 91 and continue along upper edges of lower torso segment 93. This allows for sleeve half segments 91 and the upper edges of torso segment 93 to be removably zipped onto sleeve segments 31 and shoulder segments 27 of body 15 at the front and rear of the jacket. Left and right front torso zippers 95 are provided in shell 17 to allow access to pockets sewn into the shell. A pair of torso side zippers 97 are openable to allow access to corresponding pocket zippers 69 within body 15 and/or to provide localized venting into jacket 11 even when shell 17 is secured to body 15. A pair of elasticized pull cords 99, externally held together at each end by a compressible polymeric toggle and fabric tab, enter eyelets on each side of shell 17 and extend between the outer fabric layer and the inner fabric layer. These cords are used to tighten the lateral periphery of shell 17 in use to minimize air entry. A main zipper attachment system 101 vertically extends along a front torso centerline.

Figure 4:
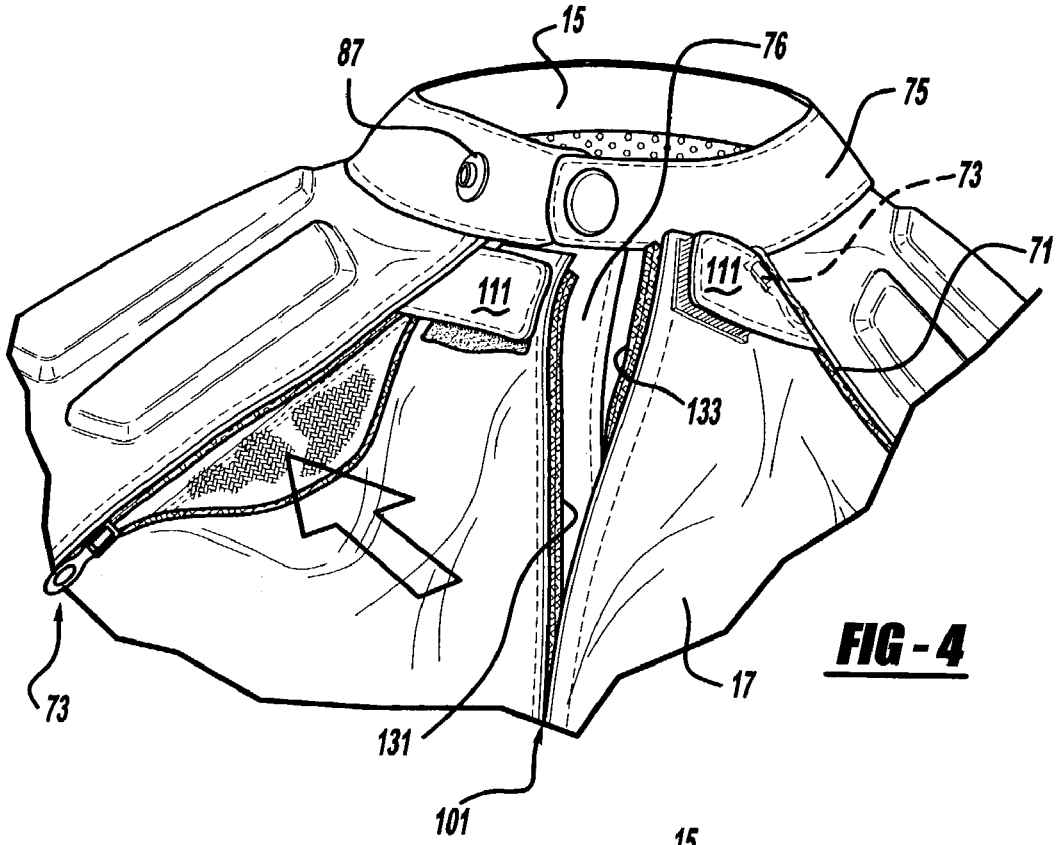
FIG. 4 is an enlarged front elevational view showing shell attachment systems in a first positional arrangement employed with the preferred embodiment garment.
Figure 5:
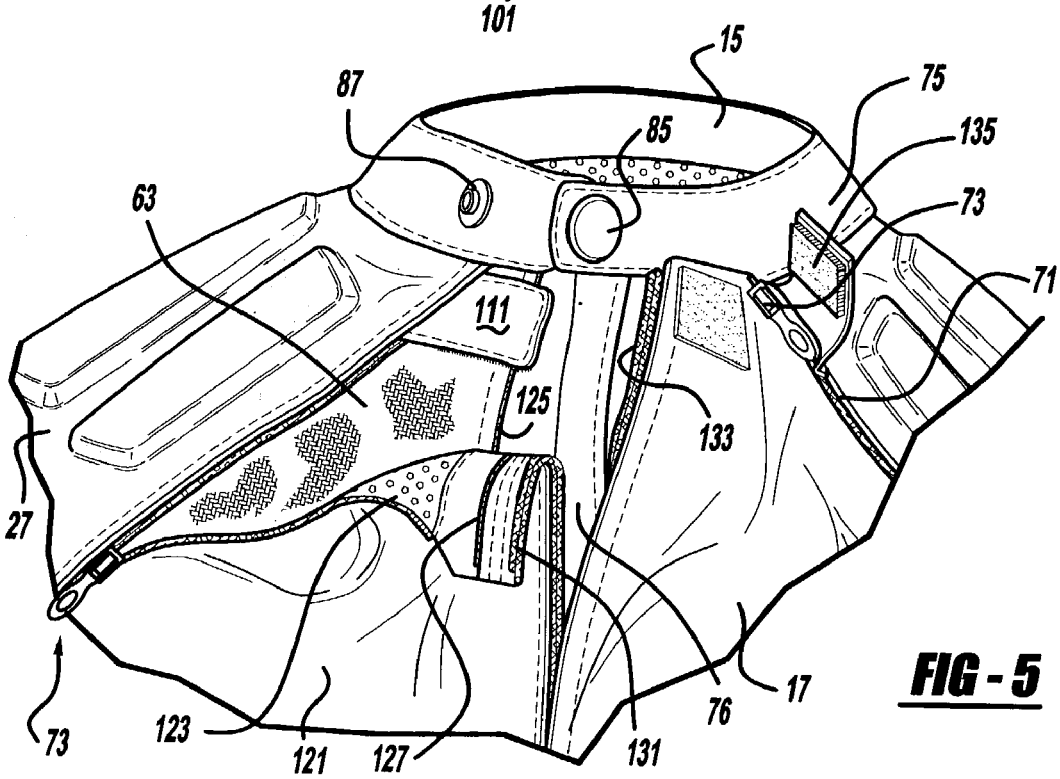
FIG. 5 is an enlarged front elevational view showing shell-to-body attachment systems in a second positional arrangement employed with the preferred embodiment garment.
Figure 6:
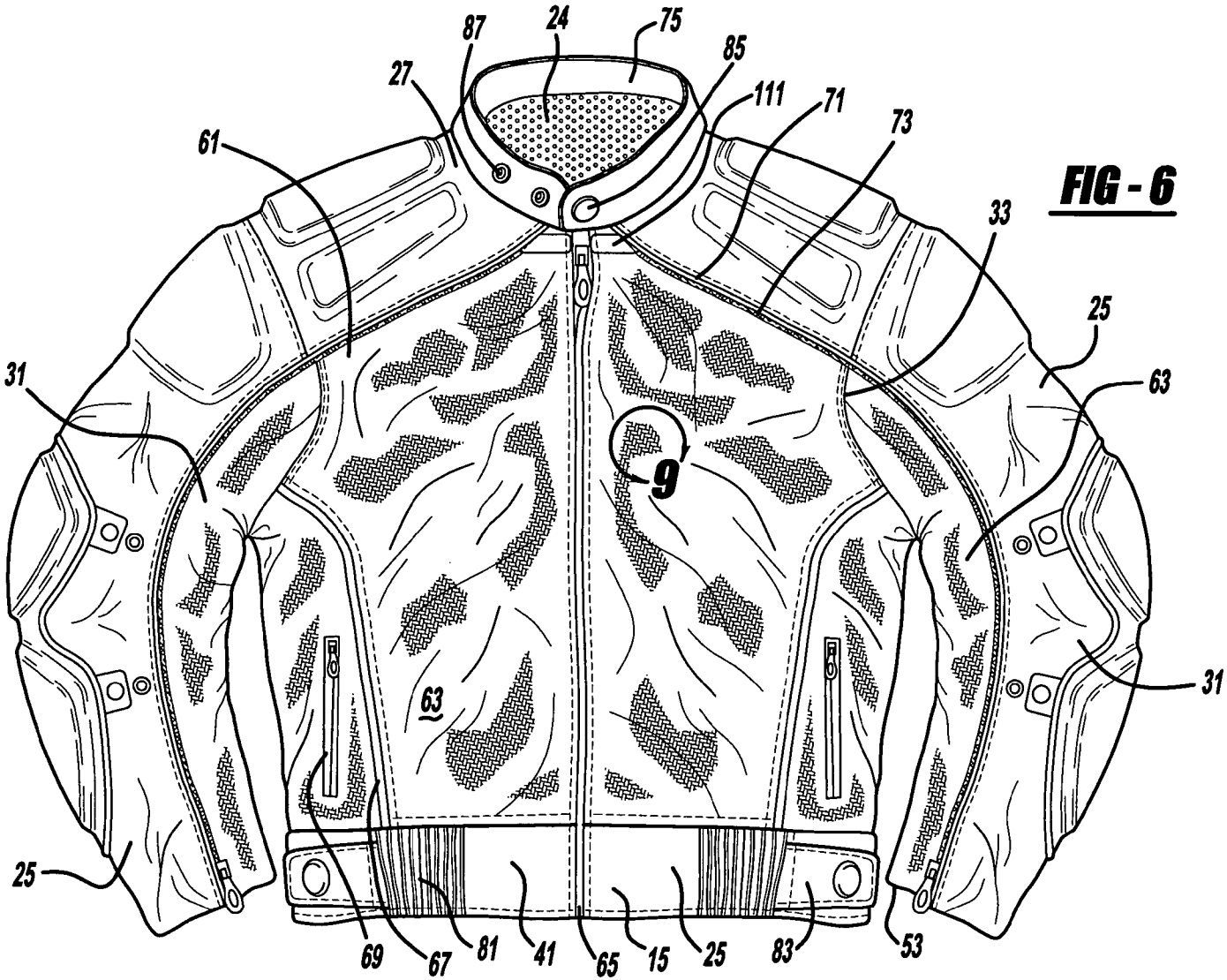
FIG. 6 is a front elevational view showing the preferred embodiment garment, with the shell removed.
Figure 7:
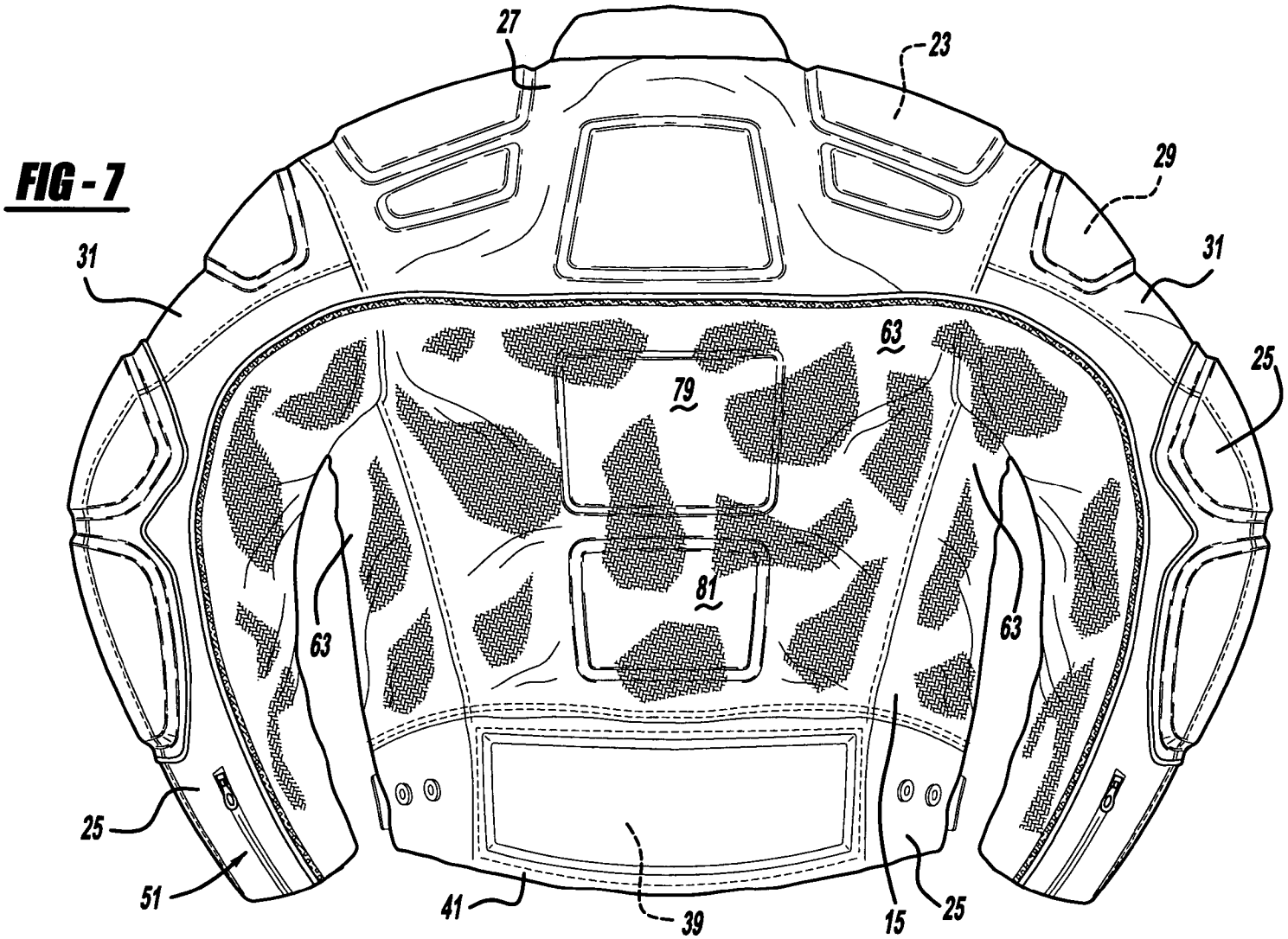
FIG. 7 is a rear elevational view showing the preferred embodiment garment, with the shell removed.

As can best be observed in FIGS. 2, 4–6 and 8, the front zipper scheme is as follows. When shell 17 is removed from body 15, the front centerline torso is closed by zipper system 65 as shown in FIG. 6. When shell 17 is attached to body 15, however, an inwardly projecting zipper track 125 of main zipper system 65 engages with an outwardly projecting zipper track 127 which has a zipper pull slide, of shell's main zipper system 101, for each side of the central opening. Furthermore, when in the attached shell-to-body condition, the inwardly projecting zipper tracks 131 and 133 of main zipper system 101 engage each other to serve as the sole front closure between the left and right front torso sections for both shell 17 and body 15. This allows for very easy, single zipper use of the jacket when the user wishes to secure or unsecure the front. Additionally, when shell 17 is attached to body 15, flaps 111 are positioned to cover the upper ends of front supplemental zipper systems 73 to deter wind and cold from entering between the upper edge of shell 17 and collar 75. More specifically, a proximal end of each flap 111 is sewn to shoulder segment 27 adjacent piping welt 71. Flap 111 is made of a flexible fabric material and has one portion of a hook and loop-type fastener attachment 135 on an inside thereof for mating with the opposite side of the hook and loop-type fastener attachment sewn onto shell 17. Thus, each flap 111 extends across the underlying supplemental zipper system 71 but without obstructing or covering main vertical zipper system 101, or even central zipper 65 when shell 17 is removed from body 15. Furthermore, one or both supplemental zipper systems 73 can be partially unzipped with the flap attachment 135 engaged, as shown in FIG. 4, to allow for localized front venting while shell 17 is otherwise still in place.

While various aspects of the present invention have been disclosed, it should be appreciated that variations may be made without departing from the scope of the present invention. For example, shell 17 may include a thermally insulative layer sewn to the inside thereof, containing polyester fiber batting, foam or goose down, for protection against cold weather; in this variation, a lightweight shell fabric (with less abrasion resistance) of about 70 denier would be used with insulation of about 70 to 200 grams. Furthermore, it is alternately envisioned that a fleece or other non-mesh, yet air permeable, material can be substituted in place of the mesh lower torso segment of body 15. Moreover, snap, hook and loop, interlocking barb, button and other disengagable fasteners can be employed instead of the preferred zippers and snaps, although some of the wind deterrent benefits of the present invention may not be realized. Shirts and other such garments may readily employ certain aspects of the present invention, although some of the advantages of the present invention may not be achieved. The preferred mesh ventilation material may solely be used on the sleeves, the torso, and/or localized portions thereof as long as an outer removable covering is provided, although again, some of the advantages of the present invention may not be fulfilled. Additional PVC or other waterproof coatings may be provided on any of the fabric layers to provide water resistance or waterproofing. It is also envisioned that the outer mesh material employed on the lower torso area of the body can be perforated with 1 millimeter by 4 millimeter long slits or cuts as long as ventilation is achieved. The present invention may alternately be used by bicycle riders, waist bags can be provided at the rear of the body for receiving the removed shell, and waterproof zippers can be provided in place of those disclosed herein. Furthermore, various materials have been disclosed in an exemplary fashion, but other materials may of course be employed, although some of the advantages of the present invention may not be realized. It is intended by the following claims to cover these and any other departures from the disclosed embodiments which fall within the true spirit of the invention.

The invention claimed is:

1. A hybrid motorcycle garment comprising:

a garment body having sleeve segments, a shoulder segment and at least one torso segment;

a fabric shell including sleeve segments and a torso segment; and at least one attachment operable to connect the shell to the body;

wherein the shell externally covers at least a majority of the torso segment of the garment body when attached thereto;

wherein the shell is removable from the garment body to expose the otherwise underlying torso segment of the garment body; and wherein at least part of the sleeve and shoulder segments of the garment body and at least a majority of the sleeve and torso segments of the shell include a wind resistant outer material, and at least parts of both the sleeve and shoulder segments of the garment body are externally exposed even when the shell is attached to the garment body.

2. The garment of claim 1 further comprising air permeable material located in a substantially continuous manner along right and left lower front torso regions, right and left side regions, and right and left rear torso regions of the body below the shoulder segment.

3. The garment of claim 2 wherein the air permeable material is a perforated, polymeric mesh.

4. The garment of claim 1 further comprising:

a second attachment vertically extending substantially adjacent to a front center of the body, the second attachment disengagably attaching together the body and shell;

a third attachment located at the front of the body; and a disengagably attachable flap locally extending across the top of one of the attachments from the body to the shell but without obstructing at least one of the second and third attachments.

5. The garment of claim 1 further comprising a cuff opening adjustment member entirely located on the body.

6. The garment of claim 1 wherein the wind resistant outer material has a density of about 400 to 800 denier.

7. The garment of claim 1 further comprising motorcycle body armor located adjacent an elbow area.

8. The garment of claim 1 further comprising a back zipper extending substantially from a first sleeve end, up a first of the sleeve segments, across an upper back portion, down a second of the sleeve segments and terminating substantially at a second sleeve end.

9. A motorcycle jacket comprising:

(a) a garment body having sleeve segments, a shoulder segment and torso segments;

(b) an air permeable material located on the body;

(c) a shell including sleeve segments and a torso segment;

(d) a back zipper system operable to continuously connect the shell to the body along at least the sleeve segments and the shoulder segment;

(e) a front zipper system disengagably attaching together the body and the shell substantially from an open end of each of the sleeve segments to a neck opening; and (f) a third zipper system vertically extending substantially adjacent to a front center of the garment;

(g) wherein the shell externally covers at least a majority of the torso segments and sections of the sleeve segments of the garment body when attached thereto;

(h) wherein the shell is removable from the garment body to expose the otherwise underlying sleeve and torso segments of the garment body;

(i) wherein at least parts of both the sleeve and shoulder segments of the garment body are externally exposed even when the shell is attached to the garment body;

(j) wherein the sleeve and torso segments of the shell are permanently attached together and the shell is entirely removable from the body; and (k) wherein the body is configured for use in motorcycle riding.

10. The jacket of claim 9 wherein both of the torso and sleeve segments of the garment body include air permeable material.

11. The jacket of claim 10 wherein at least part of the sleeve and shoulder segments of the garment body and the sleeve and torso segments of the shell include a wind resistant outer material.

12. The jacket of claim 9 wherein the wind resistant upper sections extend substantially continuously from open sleeve ends to a neck opening.

13. The jacket of claim 9 further comprising an air permeable material of each of the sleeves of the garment body being substantially continuously located between a cuff and an armpit seam.

14. The jacket of claim 9 further comprising a cuff opening adjustment member entirely located on the body.

15. The jacket of claim 9 further comprising preformed and polymeric body armor attached to the body.

16. A garment comprising:

(a) a first garment portion comprising:

permanently attached sleeves each having a first section including an air flow deterring material and a second section including an air permeable material, the first and second sleeve sections being permanently attached together;

a torso including front and back sections including an air permeable material;

wherein the torso of the first garment portion includes a shoulder segment having a wind resistant material;

wherein each of the first sleeve sections has an upper and wind resistant sleeve section which substantially extends from an open distal end of the sleeve to the shoulder segment;

(b) a second garment portion comprising:

a sleeve section including an air flow deterring material; and a torso section including an air flow deterring material;

(c) the second garment portion being removably attachable to the first garment portion in order to deter air flow through the air permeable sections of the first garment portion but allowing air to pass through the air permeable sections of the first garment portion when the second garment portion is removed.

17. The garment of claim 16 further comprising at least one attachment system disengagably attaching together the first and second garment portions substantially from an open distal end of each of the sleeves to a neck opening.

18. The garment of claim 17 wherein the attachment system includes an elongated zipper, and the sleeve section and the torso section of the second garment portion are sewn together.

19. The garment of claim 17 further comprising:

a second attachment system vertically extending substantially adjacent to a front center of the garment, the second attachment system disengagably attaching together the first and second garment portions;

a third attachment system located at the front of the garment, the third attachment system disengagably attaching together left and right front torso areas of the second garment portion; and a disengagably attachable flap locally extending across the top of the first attachment system from the torso of the first garment portion to the second garment portion but without obstructing at least one of the second and third attachment systems.

20. The garment of claim 16 wherein at least part of the second garment portion is fabric.

21. The garment of claim 16 wherein the garment is a motorsport garment and the sleeves substantially extend to a user's wrist.

22. The garment of claim 21 wherein the air permeable material at the torso is located in a substantially continuous manner along right and left lower front torso regions, right and left side regions, and right and left rear torso regions below the shoulder segment.

23. The garment of claim 16 wherein the air permeable material of each of the sleeves of the first garment portion is substantially continuously located between a cuff and an armpit seam.

24. The garment of claim 16 further comprising a cuff opening adjustment member entirely located on the first section.

25. The garment of claim 16 further comprising preformed and polymeric body armor attached to the first garment portion.

26. The garment of claim 16 wherein the first garment portion is configured for use in motorcycle riding and the air flow deterring material has a density of about 400 to 800 denier.

27. The garment of claim 16 wherein the air permeable material is a perforated, polymeric mesh, and the second garment portion externally covers the air permeable material of the first garment portion.

28. The garment of claim 16 wherein the air permeable material is a fleece material.

29. The garment of claim 16 wherein the second garment portion includes cold weather insulation.

30. A hybrid motorcycle garment comprising:

a garment body having sleeve segments, a shoulder segment and at least one torso segment;

a fabric shell;

at least one attachment operable to connect the shell to the body; and a back zipper extending from a location substantially adjacent a first sleeve end, up a first of the sleeve segments, across an upper back portion, down a second of the sleeve segments and terminating at a location substantially adjacent a second sleeve end;

wherein the shell externally covers at least a majority of the torso segment of the garment body when attached thereto; and wherein the shell is removable from the garment body to expose the otherwise underlying torso segment of the garment body.

31. The garment of claim 30 wherein at least part of the torso and sleeve segments of the garment body include air permeable material, and the shell is entirely removable from the garment body.

32. The garment of claim 30 further comprising an air permeable material of each of the sleeves of the first garment portion is substantially continuously located between a cuff and an armpit seam.

33. The garment of claim 30 further comprising a cuff opening adjustment member entirely located on the body.

34. The garment of claim 30 further comprising preformed body armor attached to the body.

35. The garment of claim 30 wherein the body is configured for use in motorcycle riding.

36. A hybrid garment comprising:

a garment body having sleeve segments, a shoulder segment and torso segments;

a shell including sleeve segments and a torso segment; and at least one attachment disengageably attaching together the body and the shell substantially from an open end of each of the sleeve segments to a neck opening;

wherein the shell externally covers at least a majority of the torso segments and sections of the sleeve segments of the garment body when attached thereto; and wherein the shell is removable from the garment body to expose the otherwise underlying sleeve and torso segments of the garment body.

37. The garment of claim 36 further comprising:

a second attachment system vertically extending substantially adjacent to a front center of the garment, the second attachment system disengagably attaching together the first and second garment portions;

a third attachment system located at the front of the garment, the third attachment system disengagably attaching together left and right front torso areas of the second garment portion; and a disengagably attachable flap locally extending across the top of the first attachment system from the torso of the first garment portion to the second garment portion but without obstructing at least one of the second and third attachment systems.

38. The garment of claim 36 further comprising:

a substantially vertical main zipper located at a front torso region;

at least one supplemental zipper located in a front and upper torso region, the supplemental zipper being angled between about 30°–150° relative to the vertical main zipper;

a collar, upper ends of the main and supplemental zippers being located adjacent the collar;

a flap attachment located on one torso side of the supplemental zipper; and a flap extending from the other side of the supplemental zipper, across the upper end of the supplemental zipper and disengagably attaching to the flap attachment but without covering the main zipper.

39. The garment of claim 36 wherein the shell is totally removable from the body as a single piece and the shell is fabric.

40. The garment of claim 36 further comprising polymeric, motorcycle body armor coupled to the body.

41. A hybrid garment comprising:

a garment body having sleeve segments, a shoulder segment and torso segments;

a shell including sleeve segments and a torso segment; and at least one attachment operable to connect the shell to the body along at least the sleeve segments and the torso segments;

wherein the shell externally covers at least a majority of the torso segments and sections of the sleeve segments of the garment body when attached thereto;

wherein the shell is removable from the garment body to expose the otherwise underlying sleeve and torso segments of the garment body;

wherein at least parts of both the sleeve and shoulder segments of the garment body are externally exposed even when the shell is attached to the garment body; and wherein the exposed parts of the sleeve and shoulder segments are upper sections that include an outer wind resistant material.

42. The garment of claim 41 wherein the wind resistant upper sections extend substantially continuously from open sleeve ends to a neck opening.

43. A hybrid garment comprising:

a garment body having sleeve segments, a shoulder segment and torso segments;

a shell including sleeve segments and a torso segment; and at least one attachment operable to connect the shell to the body along at least the sleeve segments and the torso segments;

wherein the shell externally covers at least a majority of the torso segments and sections of the sleeve segments of the garment body when attached thereto;

wherein the shell is removable from the garment body to expose the otherwise underlying sleeve and torso segments of the garment body;

wherein at least parts of both the sleeve and shoulder segments of the garment body are externally exposed even when the shell is attached to the garment body; and wherein the sleeve and torso segments of the shell are permanently attached together and the shell is entirely removable from the body.

44. The garment of claim 43 further comprising a back zipper extending from a first sleeve end, up a first of the sleeve segments, across an upper back portion, down a second of the sleeve segments and terminating at a second sleeve end.

45. The garment of claim 43 further comprising polymeric, motorcycle body armor coupled to the body.

46. A motorcycle garment comprising:

a first garment portion having sleeve segments, a shoulder segment and at least one torso segment, at least one of the segments including an open mesh material;

a second garment portion; and a back zipper extending from a location substantially adjacent a first sleeve end, up a first of the sleeve segments, across an upper back portion, down a second of the sleeve segments and terminating at a location substantially adjacent a second sleeve end, the back zipper being operable to connect together the first and second garment positions;

wherein the second garment portion is at least partially removable from the first garment portion to allow airflow through the mesh material.

47. The garment of claim 46, further comprising body armor located at elbow areas and the shoulder segment of the first garment portion, and a substantially vertical front zipper connecting together the first and second garment portions, the garment portions being fabric.

* * * * *

UNITED STATES PATENT AND TRADEMARK OFFICE

CERTIFICATE OF CORRECTION

PATENT NO. : 7,111,328 B2
APPLICATION NO. : 10/366625
DATED : September 26, 2006
INVENTOR(S) : Marc A. Bay It is certified that error appears in the above-identified patent and that said Letters Patent is hereby corrected as shown below:

TITLE PAGE, No. (57), Abstract, line 4, “a torso segments” should be --torso segments--.

Column 1, line 41, “a torso segments” should be --torso segments--.

Column 3, line 11, “supplement” should be --supplemented--.

Signed and Sealed this

Twenty-second Day of May, 2007

JON W. DUDAS
*Director of the United States Patent and Trademark Office*